US010790599B2

(12) United States Patent
Fu et al.

(10) Patent No.: US 10,790,599 B2
(45) Date of Patent: Sep. 29, 2020

(54) CONNECTOR

(71) Applicant: Tyco Electronics (Shanghai) Co. Ltd., Shanghai (CN)

(72) Inventors: Xiaozhi Fu, Shanghai (CN); Ming Shi, Shanghai (CN); Hongtao Jiang, Shanghai (CN); Wei Zhang, Shanghai (CN); Dingbing Fan, Shanghai (CN); Shuzhi Wang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/413,012

(22) Filed: May 15, 2019

(65) Prior Publication Data

US 2019/0356064 A1 Nov. 21, 2019

(30) Foreign Application Priority Data

May 15, 2018 (CN) ..... 2018 2 0719244 U

(51) Int. Cl.

| | |
|---|---|
| ***H01R 4/48*** | (2006.01) |
| ***H01R 13/52*** | (2006.01) |
| ***H01R 12/58*** | (2011.01) |
| ***H01R 13/50*** | (2006.01) |
| ***H01R 13/42*** | (2006.01) |
| ***H01R 13/502*** | (2006.01) |

(52) U.S. Cl.

CPC ..... *H01R 4/48* (2013.01); *H01R 12/58* (2013.01); *H01R 13/42* (2013.01); *H01R 13/50* (2013.01); *H01R 13/502* (2013.01); *H01R 13/5208* (2013.01)

(58) Field of Classification Search

CPC ..... H01R 4/4818; H01R 4/4827; H01R 4/48; H01R 12/58; H01R 13/5208; H01R 13/50; H01R 13/42; H01R 13/502

USPC ..... 439/441

See application file for complete search history.

(56) References Cited

U.S. PATENT DOCUMENTS

| | | | | |
|---|---|---|---|---|
| 4,149,766 | A * | 4/1979 | Stenz | H01R 4/4818 439/441 |
| 6,093,052 | A * | 7/2000 | Wang | H01R 4/4818 439/439 |
| 6,109,952 | A * | 8/2000 | Jaag | H01R 4/4827 439/224 |
| 7,229,313 | B1 * | 6/2007 | Keckler | H01R 4/4818 439/272 |
| 7,833,038 | B1 * | 11/2010 | King, Jr. | H01R 4/4818 439/276 |
| 7,833,047 | B2 * | 11/2010 | Pizzi | H01R 4/4827 439/395 |
| 7,972,166 | B2 * | 7/2011 | Hiner | H01R 4/4818 439/441 |
| 2002/0004343 | A1 * | 1/2002 | Morikawa | H01R 13/6395 439/716 |
| 2003/0194918 | A1 * | 10/2003 | Fricke | H01R 4/4818 439/835 |

(Continued)

*Primary Examiner* — Gary F Paumen

(74) *Attorney, Agent, or Firm* — Barley Snyder

(57) ABSTRACT

A connector comprises a connector module including an insulation body in which a chamber and a wire hole are formed, a contact received in the chamber, and an elastic clip disposed in the chamber. The elastic clip is adapted to press a conductor of a wire inserted into the chamber through the wire hole against the contact. The conductor of the wire electrically contacts the contact.

20 Claims, 7 Drawing Sheets

(56) References Cited

U.S. PATENT DOCUMENTS

| | | | | |
|---|---|---|---|---|
| 2004/0077210 | A1* | 4/2004 | Kollmann | H01R 4/4818<br>439/441 |
| 2005/0029003 | A1* | 2/2005 | Conrad | H01R 9/2608<br>174/68.2 |
| 2005/0181681 | A1* | 8/2005 | Arai | H01R 4/4818<br>439/787 |
| 2007/0178747 | A1* | 8/2007 | Schrader | H01R 4/4827<br>439/441 |
| 2012/0264339 | A1* | 10/2012 | Brand | H01R 4/4827<br>439/733.1 |
| 2014/0082938 | A1* | 3/2014 | King, Jr. | H01R 13/5208<br>29/863 |
| 2017/0077623 | A1* | 3/2017 | Kamo | H01R 9/2416 |
| 2017/0250478 | A1* | 8/2017 | Spey | H01R 9/2608 |
| 2018/0248283 | A1* | 8/2018 | Ono | H01R 4/4827 |
| 2019/0214746 | A1* | 7/2019 | Zhang | H01R 13/50 |

* cited by examiner

CONNECTOR

CROSS-REFERENCE TO RELATED APPLICATION

This application claims the benefit of the filing date under 35 U.S.C. § 119(a)-(d) of Chinese Patent Application No. 201820719244.9, filed on May 15, 2018.

FIELD OF THE INVENTION

The present invention relates to a connector and, more particularly, to a connector with an insulation body and a contact received in the insulation body.

BACKGROUND

A connector for connecting a wire generally includes an insulation housing and a contact received in the insulation housing. The contact is usually crimped on a conductor of the wire to electrically connect the conductor of the wire. However, it is time-consuming to crimp the contact onto the conductor of the wire, and it is difficult to replace the wire after the contact is crimped on the conductor of the wire.

SUMMARY

A connector comprises a connector module including an insulation body in which a chamber and a wire hole are formed, a contact received in the chamber, and an elastic clip disposed in the chamber. The elastic clip is adapted to press a conductor of a wire inserted into the chamber through the wire hole against the contact. The conductor of the wire electrically contacts the contact.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
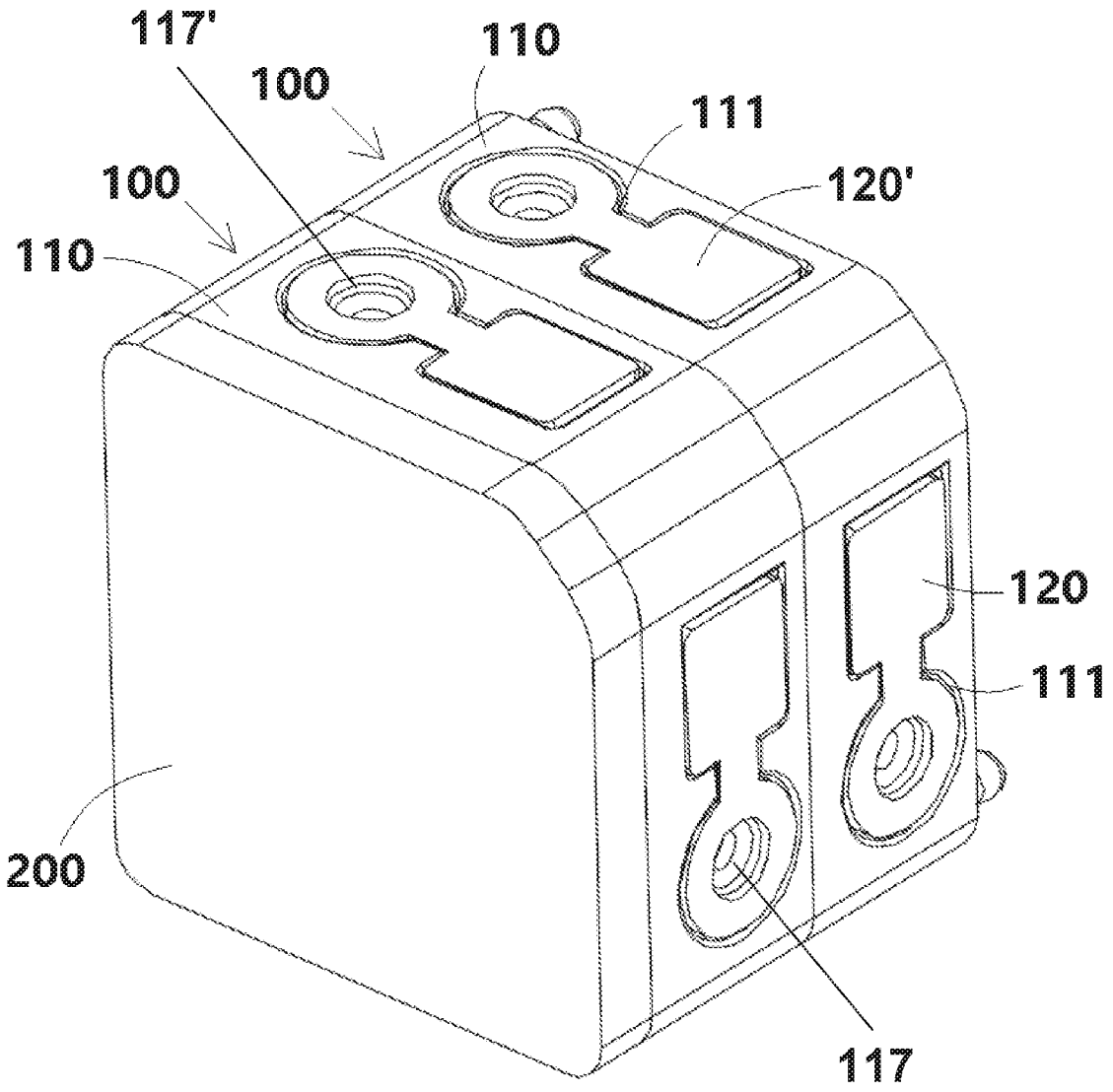
FIG. 1 is a perspective view of a connector according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
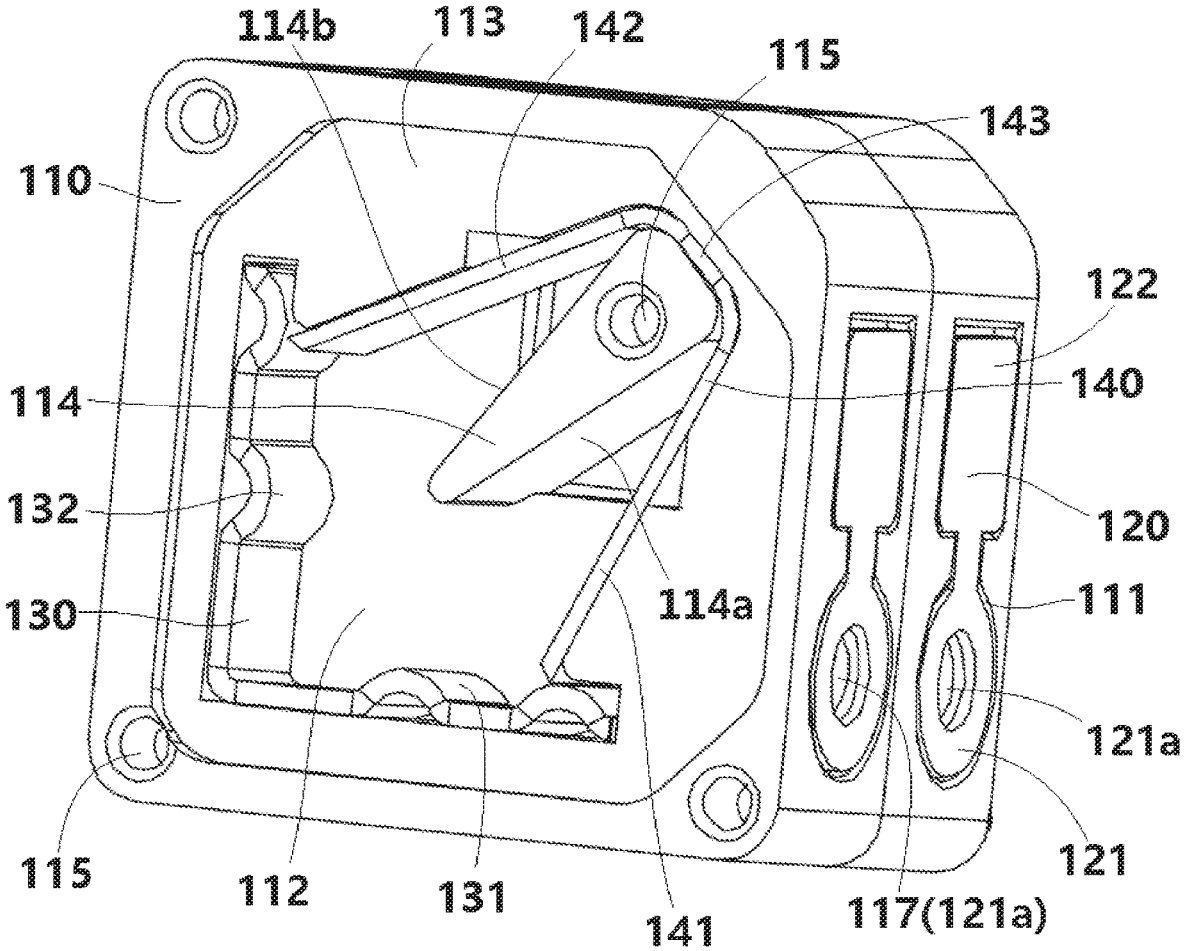
FIG. 2 is a perspective view of the connector without a cover.

As shown in the embodiment of FIGS. 1 and 2, the connector comprises at least one connector module 100. Each connector module 100 comprises an insulation body 110, a contact 130, and an elastic clip 140. A chamber 112 is formed in the insulation body 110, and a wire hole 117 is formed in the wall of the chamber 112 of the insulation body 110. The contact 130 is received in the chamber 112 of the insulation body 110. The elastic clip 140 is provided in the chamber 112.

Figure 3:
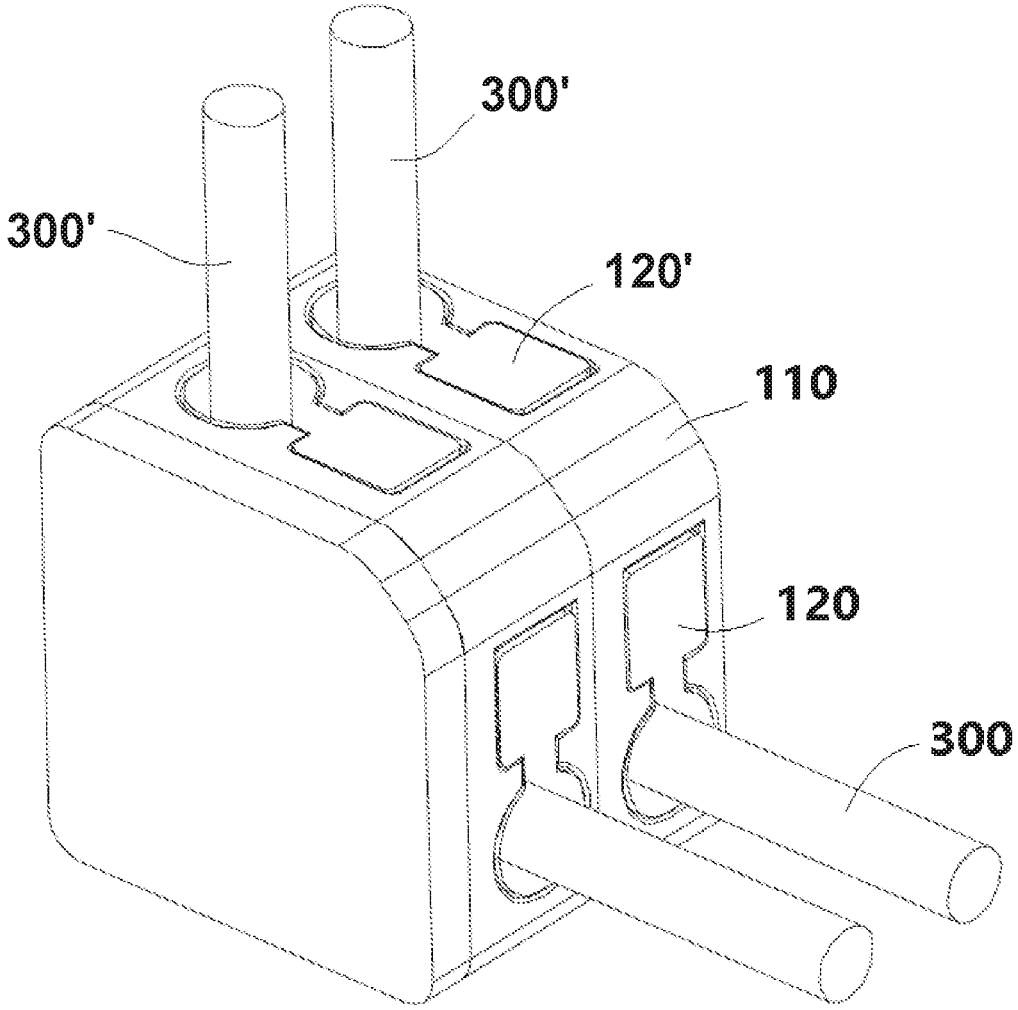
FIG. 3 is a perspective view of the connector with a wire inserted into the connector.
Figure 5:
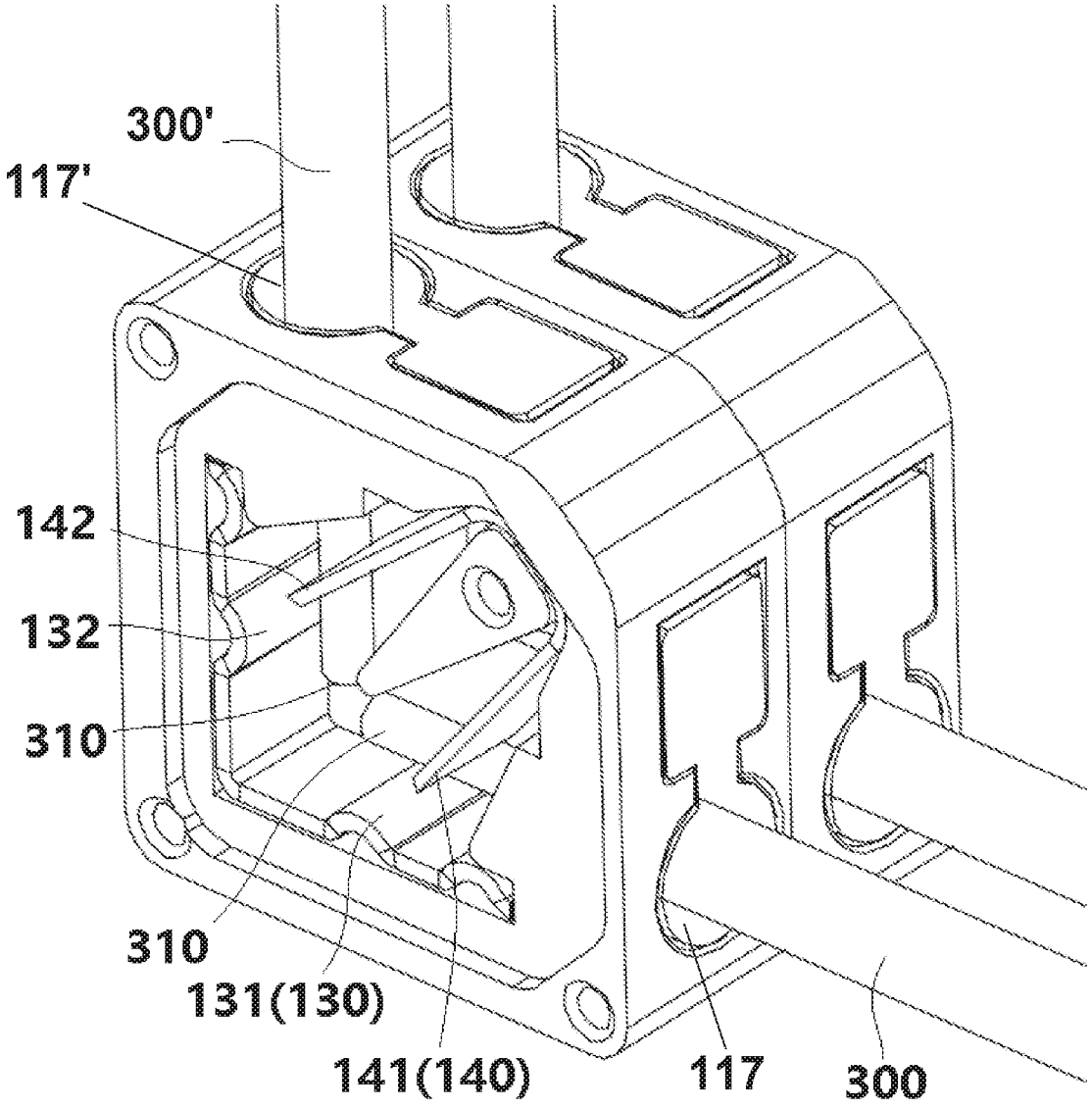
FIG. 5 is a perspective view of the connector with the wire inserted and without the cover.

As shown in FIGS. 3 and 5, a wire 300 can be inserted into the connector. The elastic clip 140 is adapted to press a conductor 310 of the wire 300, which is inserted into the chamber 112 through the wire hole 117, against the contact 130, so that the conductor 310 of the wire 300 electrically contacts the contact 130.

Figure 6:
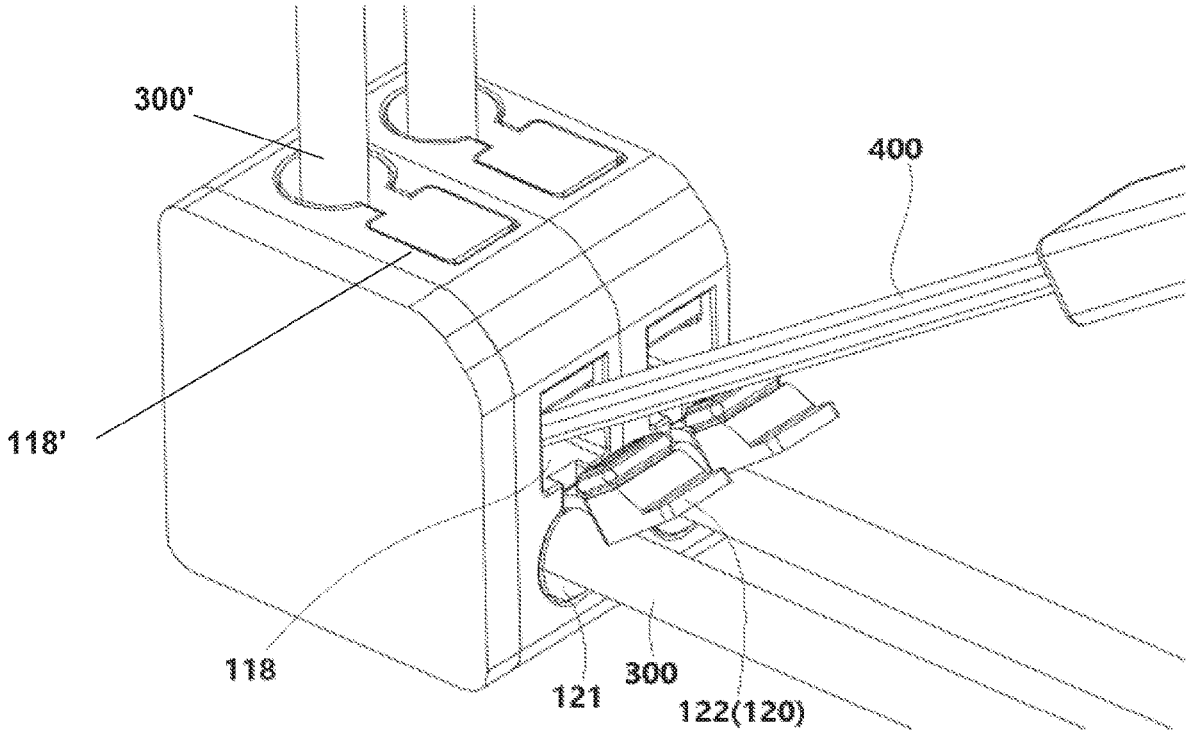
FIG. 6 is a perspective view of the connector with an external tool inserted.
Figure 7:
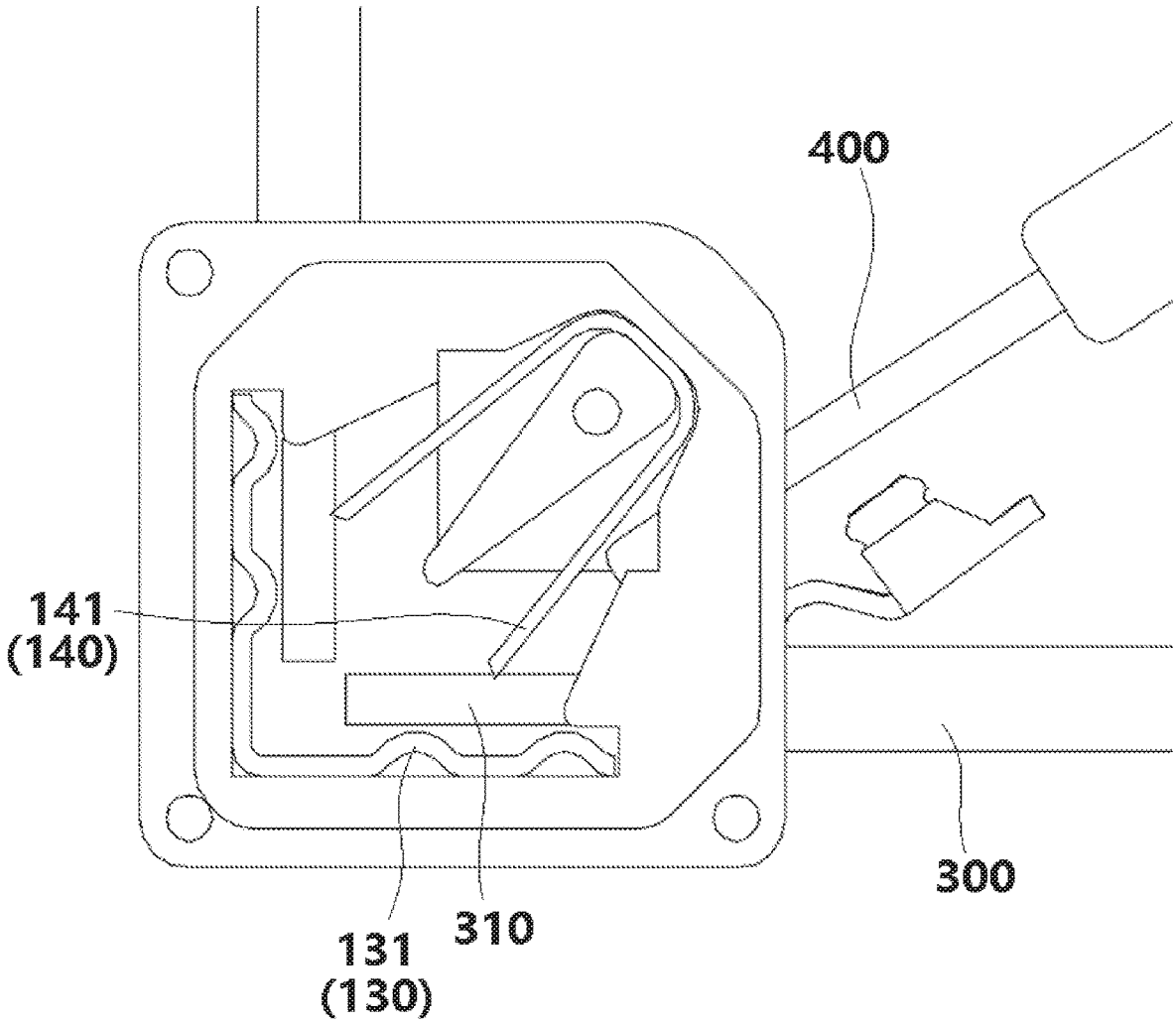
FIG. 7 is a side view of the connector without the cover and with the external tool inserted.

As shown in the embodiments of FIGS. 6-7, a tool hole 118, through which an external tool 400 is inserted into the chamber 112, is formed in the insulation body 110. The elastic clip 140 may be pushed by the inserted external tool 400 to a releasing position to release the wire 300 and allow the wire 300 to be pulled out from the connector. In this way, it is convenient to replace the wire 300.

As shown in FIGS. 2 and 5, the contact 130 has a stationary fixed arm 131, 132 and the elastic clip 140 has a movable elastic arm 141, 142. The conductor 310 of the wire 300 is adapted to be clamped and held between the elastic arm 141, 142 and the fixed arm 131, 132.

The fixed arm 131, 132 of the contact 130 has a first fixed arm 131 and a second fixed arm 132. As shown in the embodiment of FIGS. 2 and 5, an angle between the first fixed arm 131 and the second fixed arm 132 of the contact 130 is substantially equal to 90 degrees, so that the contact 130 is configured to have an L-shape.

The elastic arm 141, 142 of the elastic clip 140 has a first elastic arm 141 and a second elastic arm 142. As shown in the embodiment of FIGS. 2 and 5, an angle between the first elastic arm 141 and the second elastic arm 142 of the elastic clip 140 is less than 90 degrees, so that the elastic clip 140 is configured to have a symmetrical V-shape.

As shown in FIGS. 2 and 5, the wire hole 117 includes a first wire hole 117 and a second wire hole 117'. A first wire 300 inserted through the first wire hole 117 is clamped and held between the first elastic arm 141 and the first fixed arm 131, a second wire 300' inserted through the second wire hole 117' is clamped and held between the second elastic arm 142 and the second fixed arm 132.

As shown in the embodiment of FIGS. 6 and 7, the tool hole 118 includes a first tool hole 118 and a second tool hole 118'. The first elastic arm 141 of the elastic clip 140 is pushed by the external tool 400 inserted through the first tool hole 118 to a releasing position to release the first wire 300 and allow the first wire 300 to be pulled out from the connector. The second elastic arm 142 of the elastic clip 140 is pushed by the external tool 400 inserted through the second tool hole 118' to a releasing position to release the second wire 300' and allow the second wire 300' to be pulled out from the connector.

As shown in FIGS. 2 and 5-7, the first wire hole 117 and the first tool hole 118 are located at a first outer side wall of the insulation body 110, and the second wire hole 117' and the second tool hole 118' are located at a second outer side wall of the insulation body 110 adjacent to and perpendicular to the first outer side wall.

As shown in FIGS. 1-3 and 6, in some embodiments, the connector further comprises an elastic seal 120 adapted to seal both the wire hole 117 and the tool hole 118. The elastic seal 120 includes a first elastic seal 120 adapted to seal both the first wire hole 117 and the first tool hole 118 and a second elastic seal 120' adapted to seal both the second wire hole 117' and the second tool hole 118'.

As shown in FIG. 1, a recess 111 is formed on an outer wall of the insulation body 110. The elastic seal 120 is adapted to be embedded in the recess 111. A hole 121*a* to be aligned to the wire hole 117 is formed in the elastic seal 120, as shown in FIG. 2, and the wire 300 is adapted to pass through the hole 121*a* with interference fit. An outer port of the tool hole 118 is located in the recess 111 and is adapted to be covered and sealed by the elastic seal 120 embedded in the recess 111. In this way, the elastic seal 120 may seal the wire hole 117 and the tool hole 118.

Each elastic seal 120, as shown in FIG. 2, has a first part 121 corresponding to the wire hole 117, a second part 122 corresponding to the tool hole 118, and a neck-like part connected between the first part 121 and the second part 122. In the shown embodiment, the first part 121 and the wire hole 117 are configured to have a circular shape, and the second part 122 and the tool hole 118 are configured to have a rectangular shape.

As shown in FIGS. 2, 5, and 7, in some embodiments, the insulation body 110 of each connector module 100 has a closed bottom and a top opening, and both the contact 130 and the elastic clip 140 are assembled into the chamber 112 through the top opening.

Figure 4:
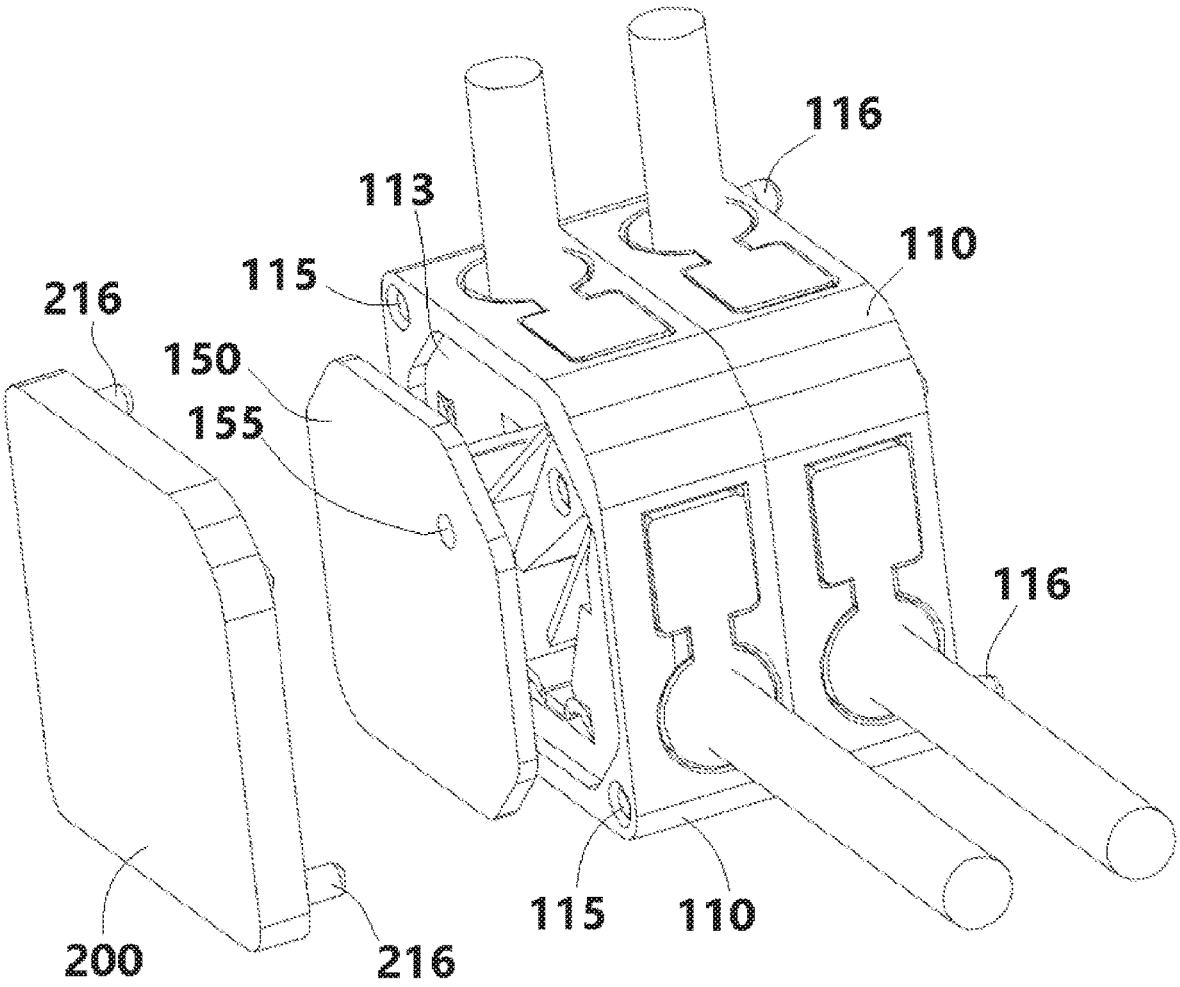
FIG. 4 is an exploded perspective view of the connector with the wire inserted.

As shown in FIG. 4, a post 116 is formed on an outer wall of the bottom of the insulation body 110. An installation hole 115 is formed in an end wall of the top opening of the insulation body 110. The post 116 is adapted to be fitted into the installation hole 115. As shown in FIGS. 1-6, in an embodiment, the connector comprises a plurality of connector modules 100. The plurality of connector modules 100 may be assembled together by fitting the post 116 of one connector module 100 into the installation hole 115 of another connector module 100.

The connector, as shown in FIGS. 1 and 4, further comprises a cover 200. The cover 200 is adapted to be mounted on the top opening of the insulation body 110 of an outermost connector module 100 of the connector, so as to cover the top opening of the outermost connector module 100. A post 216 corresponding to the installation hole 115 of the connector module is formed on the cover 200. The post 216 on the cover 200 is adapted to be fitted into the installation hole 115 of the outermost connector module 100, so as to mount the cover 200 on the top opening of the outermost connector module 100.

The connector, as shown in FIG. 4, further comprises elastic gaskets 150. An elastic gasket 150 is provided between any two adjacent connector modules 100 to seal a mating interface between the two adjacent connector modules 100; the mating interface between the bottom wall of one of the two adjacent connector modules 100 and the top opening of the other of the two adjacent connector modules 100 is sealed by the elastic gaskets 150. Similarly, an elastic gasket 150 is provided between the cover 200 and the outmost connector module 100 to seal a mating interface between the cover 200 and the top opening of the outmost connector module 100. A wall recess 113 is formed on the end wall of the top opening of the insulation body 110 of the connector module 100, and the elastic gasket 150 is fitted in the wall recess 113 with interference fit.

As shown in FIG. 2, a positioning convex part 114 is formed in the chamber 112. A positioning slot is defined between the positioning convex part 114 and an inner side wall of the chamber 112. A base part 143 of the elastic clip 140 is held in the positioning slot.

As shown in the embodiment of FIG. 2, the positioning convex part 114 is triangular and has a first blocking side 114*a* facing the first elastic arm 141 and a second blocking side 114*b* facing the second elastic arm 142. The first blocking side 114*a* is configured to limit an elastic deformation of the first elastic arm 141 and prevent excessive deformation of the first elastic arm 141, the second blocking side 114*b* is configured to limit an elastic deformation of the second elastic arm 142 and prevent excessive deformation of the second elastic arm 142. In this way, when the first elastic arm 141 or the second elastic arm 142 are pushed by the inserted external tool 400, the first elastic arm 141 or the second elastic arm 142 will be pressed against the first blocking side 114*a* or the second blocking side 114*b* by the inserted external tool 400.

As shown in FIGS. 2 and 4, each connector module 100 is formed with a plurality of installation holes 115 and a plurality of posts 116 corresponding to the plurality of installation holes 115, respectively. One of the plurality of installation holes 115 is formed in the positioning convex part 114, a hole 155 corresponding to the installation hole 115 of the positioning convex part 114 is formed in the elastic gasket 150. The post 116 of the insulation body 100 and the post 216 of the cover 200 are adapted to pass through the hole 155 of the elastic gasket 150 with interference fit.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle. Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A connector, comprising:

a connector module including:

an insulation body in which a chamber, a first wire hole and a second wire hole are formed;

a contact received in the chamber, the contact having a first fixed arm and a second fixed arm;

an elastic clip disposed in the chamber, the elastic clip having a first elastic arm and a second elastic arm, a conductor of a first wire inserted through the first wire hole is clamped and held between the first elastic arm and the first fixed arm and a conductor of a second wire inserted through the second wire hole is clamped and held between the second elastic arm and the second fixed arm; and a positioning convex part arranged within the chamber, a positioning slot is defined between the positioning convex part and an inner wall of the chamber, and a base part of the elastic clip defined between the first elastic arm and the second elastic arm is held in the positioning slot by the positioning convex part.

2. The connector of claim 1, wherein the insulation body has a tool hole through which an external tool is inserted into the chamber, the elastic clip is pushed by the external tool to a releasing position to release the first wire or the second wire and allow the wire to be pulled out from the connector.

3. The connector of claim 2, wherein the tool hole has a first tool hole and a second tool hole, the first elastic arm is pushed by the external tool inserted through the first tool hole to a releasing position to release the first wire and allow the first wire to be pulled out from the connector, and the second elastic arm is pushed by the external tool inserted through the second tool hole to a releasing position to release the second wire and allow the second wire to be pulled out from the connector.

4. The connector of claim 2, further comprising an elastic seal adapted to seal both the first wire hole and the tool hole.

5. The connector of claim 3, further comprising a first elastic seal adapted to seal both the first wire hole and the first tool hole and a second elastic seal adapted to seal both the second wire hole and the second tool hole.

6. The connector of claim 4, wherein a recess is formed on an outer wall of the insulation body and the elastic seal is adapted to be embedded in the recess, a hole aligned to the first wire hole is formed in the elastic seal and the first wire is adapted to pass through the hole with an interference fit, an outer port of the tool hole is located in the recess and is sealed by the elastic seal embedded in the recess.

7. The connector of claim 6, wherein the elastic seal has a first part corresponding to the first wire hole, a second part corresponding to the tool hole, and a neck-like part connected between the first part and the second part.

8. The connector of claim 7, wherein the first part and the first wire hole each have a circular shape and the second part and the tool hole each have a rectangular shape.

9. The connector of claim 1, wherein the insulation body of the connector module has a closed bottom and a top opening, the contact and the elastic clip are assembled into the chamber through the top opening.

10. The connector of claim 9, wherein an outer wall of the bottom of the insulation body has a post and an end wall of the top opening of the insulation body has an installation hole, the post is adapted to be fitted into the installation hole.

11. The connector of claim 10, further comprising a plurality of connector modules assembled together with the post of a first connector module fit into the installation hole of a second connector module.

12. The connector of claim 11, further comprising a cover adapted to be mounted on the top opening of the insulation body of an outermost connector module of the plurality of connector modules.

13. The connector of claim 12, wherein the cover has a post adapted to be fitted into the installation hole of the outermost connector module to mount the cover on the top opening of the outermost connector module.

14. The connector of claim 13, further comprising a first elastic gasket and a second elastic gasket, the first elastic gasket is disposed between a pair of adjacent connector modules of the plurality of connector modules to cover and seal the top opening of one of the pair of adjacent connector modules, the second elastic gasket is disposed between the cover and the outermost connector module to cover and seal the top opening of the outermost connector module.

15. The connector of claim 14, wherein the end wall of the top opening of the insulation body has a wall recess, the first elastic gasket is fitted in the wall recess with an interference fit.

16. The connector of claim 15, wherein each connector module has a plurality of installation holes and a plurality of posts corresponding to the plurality of installation holes, one of the plurality of installation holes is formed in the positioning convex part, the second elastic gasket has a hole aligned to the installation hole in the positioning convex part and the post of the insulation body and the post of the cover are adapted to pass through the hole in the elastic gasket with an interference fit.

17. The connector of claim 1 wherein the positioning convex part is triangular and has a first blocking side facing the first elastic arm and a second blocking side facing the second elastic arm, the first blocking side is configured to limit an elastic deformation of the first elastic arm so as to prevent excessive deformation of the first elastic arm and the second blocking side is configured to limit an elastic deformation of the second elastic arm so as to prevent excessive deformation of the second elastic arm.

18. A connector module including:

an insulation body defining a chamber, a first wire hole and a second wire hole formed through the body and opening into the chamber;

a contact disposed in the chamber and defining a first fixed arm extending in a first direction and a second fixed arm extending from the first fixed arm in a second direction, distinct from the first direction; and an elastic clip disposed in the chamber, the elastic clip defining a first elastic arm, a second elastic arm, and a base portion connected therebetween, a conductor of a first wire inserted through the first wire hole is configured to be clamped and held between the first elastic arm and the first fixed arm, and a conductor of a second wire inserted through the second wire hole is configured to be clamped and held between the second elastic arm and the second fixed arm.

19. The connector module of claim 18, further comprising a positioning convex part arranged within the chamber, the base portion of the elastic clip held by the positioning convex part in a positioning slot defined between the positioning convex part and an inner wall of the chamber, the positioning convex part comprising:

a first blocking side facing the first elastic arm in a first direction; and a second blocking side facing the second elastic arm in a second direction, distinct from the first direction, wherein the first blocking side is configured to limit an elastic deformation of the first elastic arm so as to prevent excessive deformation of the first elastic arm and the second blocking side is configured to limit an elastic deformation of the second elastic arm so as to prevent excessive deformation of the second elastic arm.

20. The connector module of claim 18, wherein the second fixed arm extends generally perpendicularly from the first fixed arm.

* * * * *